US005363183A

United States Patent [19]

Reese et al.

[11] Patent Number: 5,363,183

[45] Date of Patent: Nov. 8, 1994

[54] COPYING MACHINE WITH DEVICE FOR REMOVING CARRIER BEADS FROM THE PHOTOCONDUCTIVE SURFACE

[75] Inventors: Scott A. Reese, Farmington; Dan F. Lockwood, Ontario; James Strollo, Rochester; Stephen L. Logan, Penfield, all of N.Y.

[73] Assignee: Xerox Corporation, Stamford, Conn.

[21] Appl. No.: 755,997

[22] Filed: Sep. 6, 1991

[51] Int. Cl.[5] ..... G03G 21/00

[52] U.S. Cl. ..... 355/305; 355/212

[58] Field of Search ..... 355/212, 305, 213, 296, 355/200; 118/652

[56] References Cited

U.S. PATENT DOCUMENTS

| | | | |
|---|---|---|---|
| 3,543,720 | 12/1970 | Drexler et al. | 355/253 X |
| 3,834,804 | 9/1974 | Bhagat et al. | 355/306 |
| 4,552,451 | 11/1985 | Yamazaki et al. | 355/305 |
| 4,739,371 | 4/1988 | Ray et al. | 355/212 |
| 4,806,991 | 2/1989 | Guslits | 355/212 |
| 4,868,607 | 9/1989 | Folkins et al. | 118/652 X |
| 4,885,612 | 12/1989 | Satoh et al. | 355/305 |
| 4,918,488 | 4/1990 | Creveling et al. | 355/296 |
| 5,081,503 | 1/1992 | Parker et al. | 355/296 |

FOREIGN PATENT DOCUMENTS

| | | | |
|---|---|---|---|
| 0049370 | 3/1985 | Japan | 355/212 |
| 1441288 | 6/1976 | United Kingdom | 355/305 |

*Primary Examiner*—A. T. Grimley
*Assistant Examiner*—Robert Beatty
*Attorney, Agent, or Firm*—Kenyon & Kenyon

[57] ABSTRACT

An apparatus for removing magnetic carrier beads and similar particles from a photoconductive surface includes a magnetic roller for magnetically attracting and removing the beads from the photoconductive surface. A housing has at least one v-shaped support, and the housing contains the magnetic roller. A back-up shaft is disposed on a side of the photoconductive surface opposite the housing and is supported by the v-shaped support. The shaft and the magnetic roller form a uniform gap having a width of 0.65 +/−0.10 mm.

3 Claims, 3 Drawing Sheets

COPYING MACHINE WITH DEVICE FOR REMOVING CARRIER BEADS FROM THE PHOTOCONDUCTIVE SURFACE

BACKGROUND OF THE INVENTION

This invention relates generally to an electrophotographic printing machine, and more particularly concerns an apparatus for removing magnetic carrier beads and similar particles from a photoconductive surface.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

The electrostatically attractable developing material commonly used in developing systems comprises a pigmented resinous powder referred to here as a "toner" and a "carrier" of larger granular carrier beads formed with steel cores coated with a material removed in the triboelectric series from the toner so that a triboelectric charge is generated between the toner powder and the granular carrier. The toner is attracted to the electrostatic latent image from carrier bristles to produce a visible powder image on an insulating surface of the photoconductive material. Generally, in an endless belt printing machine configuration which employs a plurality of magnetic brushes, the brushes are arranged for developing purposes with a run of the belt in the planar orientation.

In most copiers, however, some carrier beads will adhere to the photoconductive surface of the belt after the latter leaves the development zone. These adhering carrier beads prevent intimate contact between the support surface (e.g., a sheet of paper) and the toner particles, and they may affect the quality of the copy produced. In addition, because such adhering carrier beads are hard, they may abrade the photoconductive surface of the belt if not removed prior to reaching the cleaning zone. Consequently, it is highly desirable that all such carrier beads be removed from the belt after the latter leaves the developing zone. It is also desirable that the means used to remove such carrier beads be capable of being easily removed and replaced for servicing, etc., without contacting the surface of the belt in so doing.

A known bead pick-off device, such as that disclosed in U.S. Pat. No. 3,834,804 issued to Bhagat et al., includes a non-magnetic cylindrical pick-off roller rotatably mounted immediately adjacent to the moving photoconductive belt. A stationarily mounted magnet and pole piece located within the roller creates a magnetic field necessary for attracting carrier beads to and holding them on the roller so as to be conveyed along a course away from the photoconductive belt. The magnetic field decreases sufficiently at a location along the course to permit the carrier beads at that location to descend via gravity into a receptacle located beneath the pick-off roller. It is important that the width of the gap between the photoconductive belt and the pick-off roller be maintained with extreme accuracy so that the proper value of the magnetic field is generated; any change in the width of the gap will result in a change in the value of the magnetic field at the site of the carrier beads, producing a field that is either too strong or too weak to properly remove the beads from the photoconductive belt. One limitation of known bead pick-off devices is that the width of the gap cannot be maintained to within the necessary tolerance over a period of time during which the belt is removed and replaced, without the need for also adjusting the gap width.

SUMMARY OF THE INVENTION

In accordance with one aspect of the present invention, there is provided an apparatus for removing magnetic carrier beads and similar particles from a photoconductive surface that includes means for magnetically attracting and removing the beads from the photoconductive surface. A housing has at least one v-shaped support, and the housing contains the magnetically attracting means. A back-up shaft is disposed on a side of the photoconductive surface opposite the housing and is supported by the v-shaped support. The shaft and the magnetically attracting means form a uniform gap therebetween.

Pursuant to another aspect of the present invention, there is provided a printing machine of a type having a toner image developed on a moving member. The printing machine comprises an apparatus for removing magnetic carrier beads and similar particles from the moving member that includes means for magnetically attracting and removing the beads from the photoconductive surface and a nonmagnetic back-up shaft. A housing has means for receiving the back-up shaft. The housing contains the magnetically attracting means, and the back-up shaft is disposed on a side of the moving member that is opposite the housing. The shaft and the magnetically attracting means form a uniform gap therebetween.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Other features of the present invention will become apparent as the following description proceeds and upon reference to the drawings.

DETAILED DESCRIPTION

Figure 1:
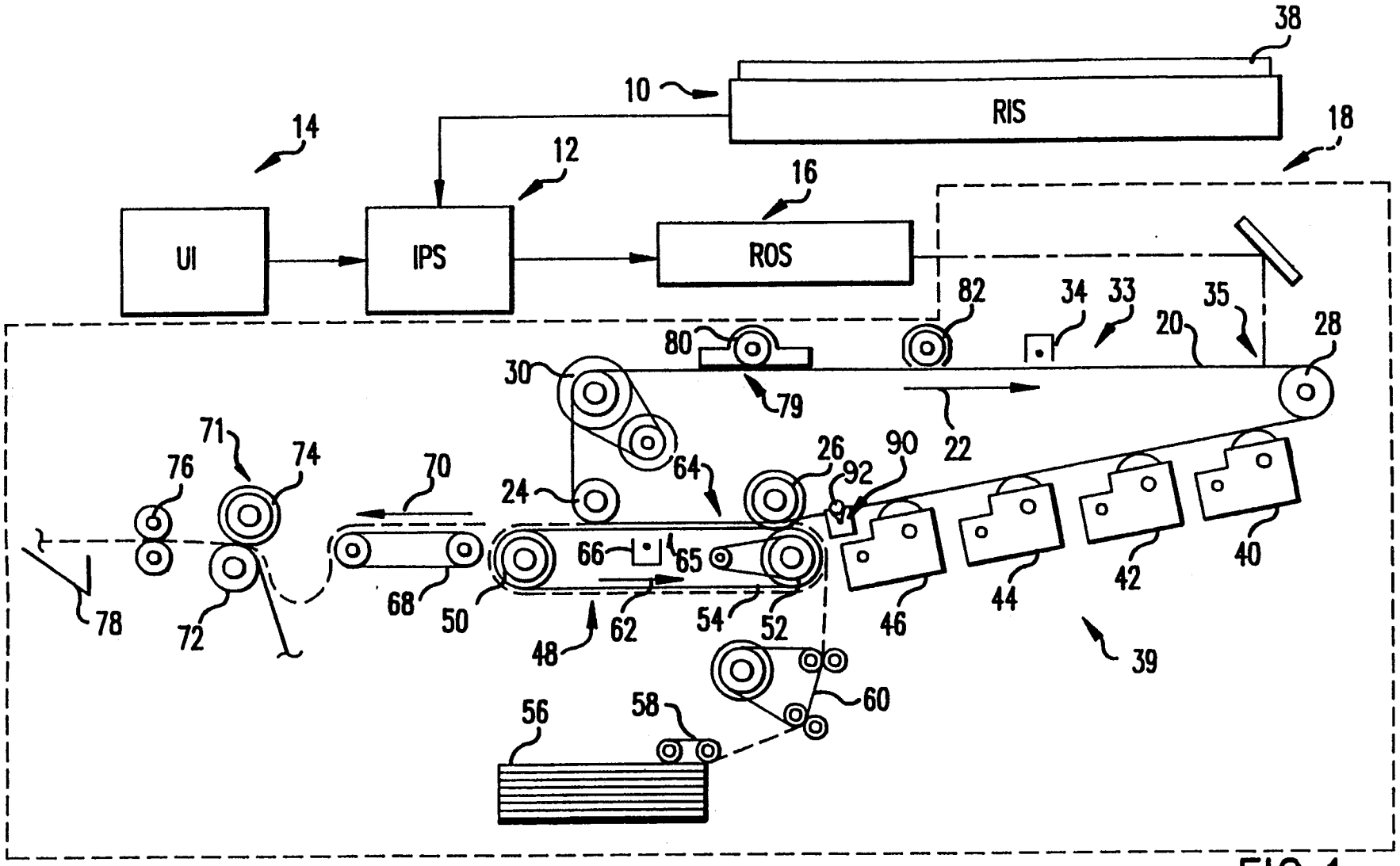
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

The photoconductive belt moves in the direction of arrow 22 to advance successive portions of the photoconductive surface sequentially through the various processing stations disposed about the path of movement thereof. Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35 where a latent image is formed on the photoconductive belt 20. Next, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier beads having toner particles formed of a pigmented resinous powder adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42 and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position.

After development, the photoconductive belt 20 advances to a bead pick-off device 90, which removes the magnetic carrier beads and large toner conglomerates that adhere to the photoconductive surface of the belt 20 after the latter leaves the development zone. The configuration of the bead pick-off device will be discussed in more detail below. However, the means by which the pick-off device removes the beads from the belt 20 is known in the art, such as disclosed, for example, in U.S. Pat. No. 3,834,804, and hence will not be discussed further. After passing the bead pick-off device 90, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper extends (not shown ) between belts 54 and moves in unison therewith. A sheet is advanced from a stack of sheets 56 disposed on a tray. A friction retard feeder 58 advances the uppermost sheet from stack 56 onto a pre-transfer transport 60. Transport 60 advances sheet 25 to sheet transport 48. The sheet 25 is advanced by transport 60 in synchronism with the movement of sheet gripper. In this way, the leading edge of the sheet arrives at a preselected position, i.e. a loading zone, to be received by the open sheet gripper. The sheet gripper then closes securing the sheet thereto for movement therewith in a recirculating path. The leading edge of the sheet is secured releasably by the sheet gripper. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
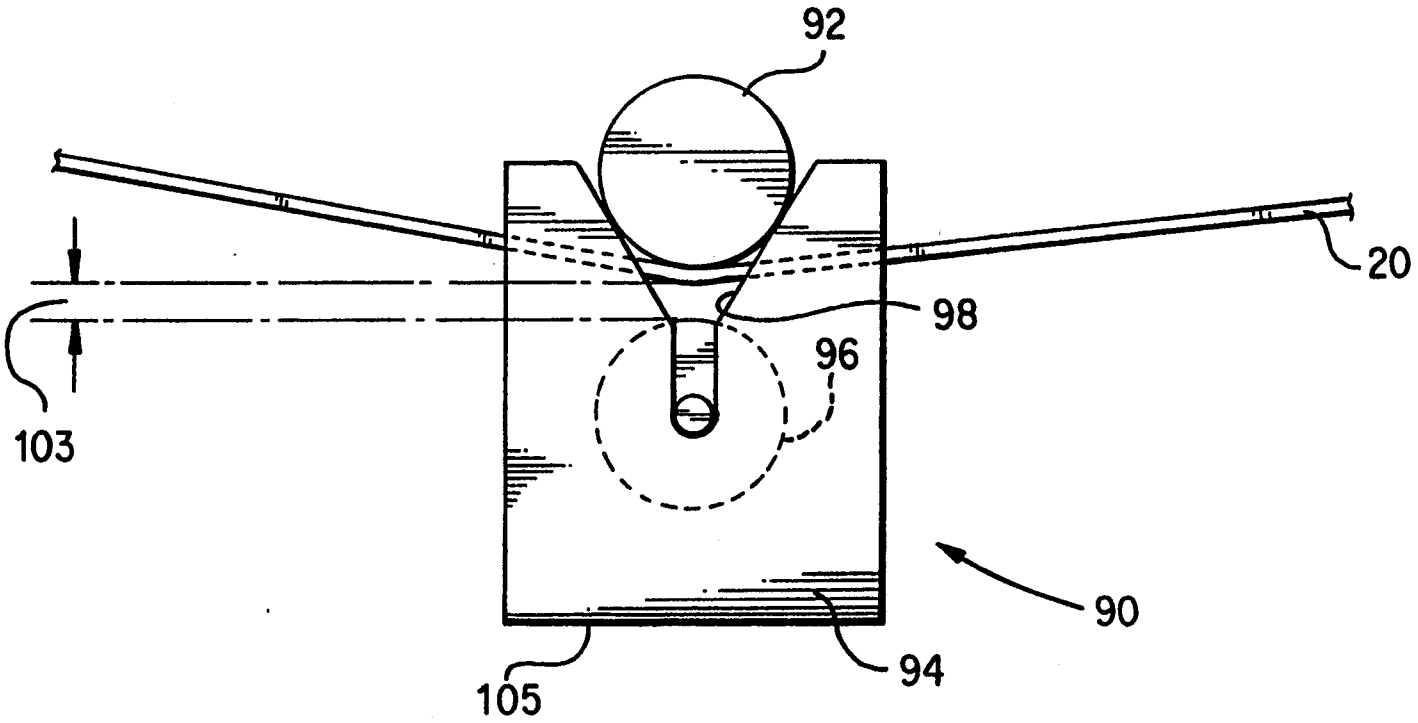
FIG. 2 is a schematic elevational view of the bead pick-off device constructed according to the principles of the invention.
Figure 3:
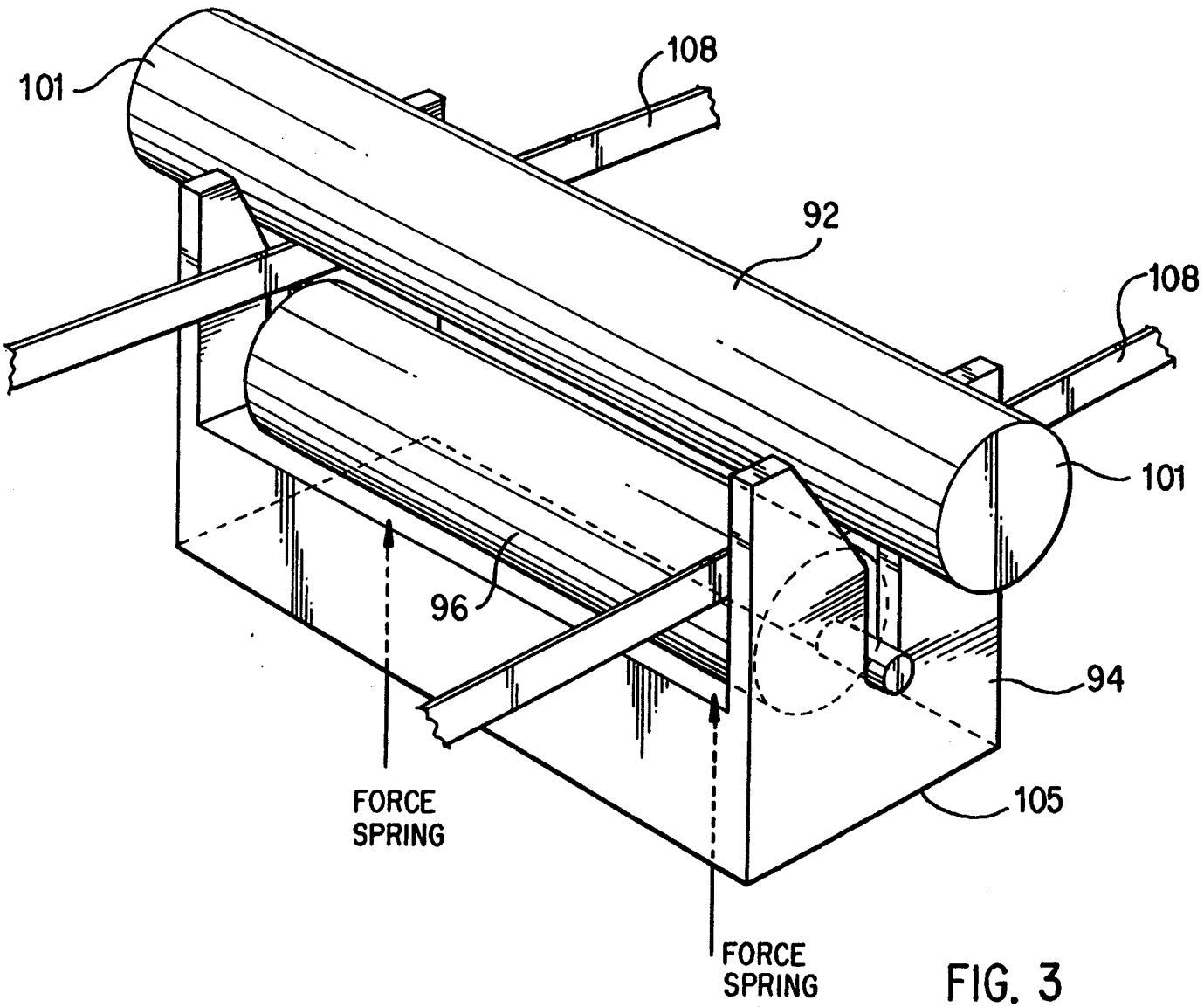
FIG. 3 is a perspective view of the bead pick-off device shown in FIG. 2.

Referring now to FIG. 2 and 3, it can be seen that the bead pick-off device 90 includes a nonmagnetic back-up shaft 92 that is nonrotatable. The shaft 92 supports the photoconductive belt 20. Situated on the side of the belt 20 directly opposite the back-up shaft 92 is a bead pick-off assembly that includes a housing 94 which contains a cylindrical magnetic pick-off roller 96. The housing 94, which may be formed from molded plastic, has a v-shaped support 98 disposed at each of its ends in which the back-up shaft 92 rests. The ends 101 of the shaft 92 extend beyond the v-shaped supports 98. The pick-off roller 96 is rotatably mounted within the housing 94, and it has a length less than that of the shaft 92. The bead pick-off assembly is fixed in position by a spring loaded support that is not shown in the Figures. The spring loaded support provides an upward force on the bottom surface 105 of the housing 94, as indicated by the arrow shown in FIG. 3, so that the assembly is properly biased against the back-up shaft 92.

The shaft 92 and the rolls 24, 26, 28, and 30 which all support the belt 20 are themselves supported by side plates 108, part of which are shown in FIG. 3. The portion of the side plates 108 passing beneath the shaft 92 are located between the two v-shaped supports 98 of the housing 94.

The configuration of the bead pick-off device 90 described above advantageously maintains a gap 103 between the photoreceptive belt 20 and the magnetic roller 96 to within a very small tolerance (i.e., high precision). Furthermore, the bead pick-off assembly can be easily installed and removed without the need for adjusting the gap width. A small tolerance in the width of the gap is necessary to generate a magnetic field having precisely the correct value to attract the magnetic carrier beads from the belt 20 to the magnetic roller 96. This small tolerance is achieved by minimizing the number of components utilized, as well as by simplifying the manner in which they mount together. In particular, the uniformity of the gap is maintained by requiring that the shaft 92 be nonrotatable and by mounting the bead pick-off assembly directly to the back-up shaft 92. In one embodiment of the invention, the gap 103 has a width of 0.65 millimeters, $+/-0.10$ millimeters. This uniform gap can be maintained even after repeatedly removing the bead pick-off assembly and replacing the belt 20.

It is, therefore, apparent that there has been provided in accordance with the present invention, a bead pick-off device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for removing magnetic carrier beads and similar particles from a photoconductive surface comprising:

a magnetic cylindrical roller having a longitudinal axis, said magnetic roller attracting and removing carrier beads from a photoconductive surface;

a self-contained housing within an electrophotographic printing machine having two v-shaped supports forming an integral unit with said housing, each of said v-shaped supports is formed in a side wall of said housing wherein said side walls are disposed on opposite ends of said housing with respect to each other, said housing containing and supporting said magnetic roller, said housing and magnetic roller are capable of being removed from and installed into said electrophotographic printing machine; and a non-rotatable back-up shaft disposed on a side of the photoconductive surface opposite said housing and supported by said v-shaped supports, said back-up shaft supports said photoconductive surface, said back-up shaft having a longitudinal axis which is disposed substantially perpendicular to planar surfaces defining said side walls of the housing, the longitudinal axis of said back-up shaft being disposed substantially parallel to the longitudinal axis of said magnetic roller, said shaft and said magnetic roller forming a uniform gap therebetween having a width of 0.65 +/−0.10 millimeters, such that said uniform gap is maintained after said housing and magnetic roller have been removed and reinstalled.

2. An apparatus for removing magnetic carrier beads and similar particles from a photoconductive surface comprising:

a magnetic cylindrical roller having a longitudinal axis, said magnetic cylindrical roller attracting and removing carrier beads from a photoconductive surface;

a nonmagnetic back-up shaft supporting said photoconductive surface wherein the longitudinal axis of said magnetic roller is disposed substantially parallel to a longitudinal axis of said back-up shaft;

a self-contained housing within an electrophotographic printing machine having means for receiving said back-up shaft, said receiving means includes two v-shaped supports forming an integral unit with said housing wherein each v-shaped support is formed in a side wall of said housing, said side walls being disposed on opposite ends of said housing with respect to each other, said housing supporting said magnetic attracting means, said back-up shaft being disposed on a side of the photoconductive surface opposite said housing, the longitudinal axis of said back-up shaft is positioned substantially perpendicular to planar surfaces defining said side walls of the housing, said shaft and said magnetic roller forming a uniform gap therebetween having a width of 0.65 +/−0.10 millimeters.

3. A printing machine of a type having a toner image developed on a moving member by a developing unit, said printing machine comprising:

an apparatus for removing magnetic carrier beads and similar particles from the moving member that includes:

a magnetic cylindrical roller having a longitudinal axis, said magnetic roller magnetically attracting and removing carrier beads from the moving member;

a non-rotatable nonmagnetic back-up shaft supporting said moving member, wherein the longitudinal axis of said magnetic roller is disposed substantially parallel to a longitudinal axis of said back-up shaft;

a self-contained housing within an electrophotographic printing machine having two v-shaped supports forming an integral unit with said housing and receiving said back-up shaft, wherein each v-shaped support is formed in a side wall of said housing, said side walls being disposed on opposite ends of said housing with respect to each other, said housing containing and supporting said magnetic roller, said back-up shaft being disposed on a side of the moving member opposite said housing, wherein the longitudinal axis of said back-up shaft is positioned substantially perpendicular to planar surfaces of said side walls of said housing, said shaft and said magnetic roller forming a uniform gap therebetween having a width of 0.65 +/−0.10 millimeters, said apparatus being disposed at a position along the moving member downstream from the developing unit.

* * * * *

UNITED STATES PATENT AND TRADEMARK OFFICE

CERTIFICATE OF CORRECTION

PATENT NO. : 5,363,183

DATED : November 8, 1994

INVENTOR(S) : Scott A. Reese, et al

It is certified that error appears in the above-indentified patent and that said Letters Patent is hereby corrected as shown below:

Column 5, line 4, After "sheet gripper" insert —(not shown)—.

Column 5, line 5, Delete "(not shown)".

Column 5, line 10, Delete "25".

Signed and Sealed this

Twenty-first Day of March, 1995

*Attest:*

Bruce Lehman

BRUCE LEHMAN

*Attesting Officer*

*Commissioner of Patents and Trademarks*